US010077754B2

(12) United States Patent
Ikeda

(10) Patent No.: US 10,077,754 B2
(45) Date of Patent: Sep. 18, 2018

(54) IGNITION PLUG AND INTERNAL-COMBUSTION ENGINE

(75) Inventor: Yuji Ikeda, Kobe (JP)

(73) Assignee: IMAGINEERING, INC., Kobe-shi (JP)

( * ) Notice: Subject to any disclaimer, the term of this patent is extended or adjusted under 35 U.S.C. 154(b) by 164 days.

(21) Appl. No.: 14/119,329

(22) PCT Filed: May 23, 2012

(86) PCT No.: PCT/JP2012/063230

§ 371 (c)(1),
(2), (4) Date: Jul. 11, 2014

(87) PCT Pub. No.: WO2012/161232

PCT Pub. Date: Nov. 29, 2012

(65) Prior Publication Data

US 2014/0326206 A1 Nov. 6, 2014

(30) Foreign Application Priority Data

May 24, 2011 (JP) ..... 2011-115304

(51) Int. Cl.
*F02P 15/00* (2006.01)
*H01T 13/20* (2006.01)
(Continued)

(52) U.S. Cl.
CPC ..... *F02P 15/00* (2013.01); *F02M 27/042* (2013.01); *F02P 9/007* (2013.01); *F02P 13/00* (2013.01);
(Continued)

(58) Field of Classification Search
CPC .. F02P 3/01; F02P 23/04; F02P 23/045; F02P 9/007; F02M 27/042; H01T 13/20; H01T 13/42; H01T 13/50
(Continued)

(56) References Cited

U.S. PATENT DOCUMENTS 2,937,296 A * 5/1960 Logan ..... H01T 13/48 123/143 R
3,521,105 A * 7/1970 Franks ..... H01S 3/092 313/120
(Continued)

FOREIGN PATENT DOCUMENTS

EP 2178181 A1 4/2010
JP 04-149986 A 5/1992
(Continued)

OTHER PUBLICATIONS

English translation of JP 2009281188 A provided by Espacenet.*
International Search Report of PCT/JP2012/063230, dated Oct. 2, 2012.

*Primary Examiner* — Jacob Amick
*Assistant Examiner* — Michael A Kessler
(74) *Attorney, Agent, or Firm* — Westerman, Hattori, Daniels & Adrian, LLP

(57) ABSTRACT

Provided is an ignition plug (15) that has an antenna (54) for emitting high-frequency EM waves to combustion chamber (20) of an internal combustion engine (10), wherein the propagation velocity of the flame is augmented using the high-frequency EM waves emitted from the antenna (54). The ignition plug (15) has an ignition plug body (30) and an antenna (54). The antenna (54) is located on the front-tip side surface of the cylindrical second conductive member (33) within the ignition plug body (30), which accommodates a rod-shaped first conductive member (31) and cylindrical insulation (32) surrounding the first conductive member (31).

8 Claims, 4 Drawing Sheets

(51) Int. Cl.

| | |
|---|---|
| ***F02M 27/04*** | (2006.01) |
| ***H01T 13/42*** | (2006.01) |
| ***F02P 13/00*** | (2006.01) |
| ***H01T 13/50*** | (2006.01) |
| ***F02P 23/04*** | (2006.01) |
| *F02P 9/00* | (2006.01) |
| *F02P 3/04* | (2006.01) |

(52) U.S. Cl.
CPC ..... *F02P 15/006* (2013.01); *F02P 23/045* (2013.01); *H01T 13/20* (2013.01); *H01T 13/42* (2013.01); *H01T 13/50* (2013.01); *F02P 3/04* (2013.01); *F02P 9/002* (2013.01)

(58) Field of Classification Search
USPC ..... 123/143 R, 169 R, 169 CA, 169 EL, 123/169 E, 143 B, 606–608; 313/118; 315/111.41
See application file for complete search history.

(56) References Cited

U.S. PATENT DOCUMENTS

| | | | | | |
|---|---|---|---|---|---|
| 3,934,566 | A * | 1/1976 | Ward | F02P 9/007 | 123/143 B |
| 4,109,633 | A * | 8/1978 | Mitsudo | H01T 13/20 | 123/169 EL |
| 5,555,862 | A * | 9/1996 | Tozzi | H01T 13/50 | 123/143 B |
| 6,019,077 | A * | 2/2000 | Gorokhovsky | H01T 13/20 | 123/169 EL |
| 2010/0186368 | A1* | 7/2010 | Ikeda | F02C 7/264 | 60/39.821 |
| 2010/0187968 | A1* | 7/2010 | Ikeda | F02P 23/045 | 313/134 |
| 2011/0023458 | A1* | 2/2011 | Ikeda | F01N 3/0892 | 60/275 |
| 2011/0030347 | A1* | 2/2011 | Ikeda | F01L 3/02 | 60/275 |

FOREIGN PATENT DOCUMENTS

| | | | | |
|---|---|---|---|---|
| JP | WO 2009008520 | A1 * | 1/2009 | F02P 23/045 |
| JP | 2009281188 | A * | 12/2009 | F02P 3/01 |
| JP | 2010-101174 | A | 5/2010 | |
| JP | WO 2011043399 | A1 * | 4/2011 | F02B 19/04 |
| WO | 2009/008520 | A1 | 1/2009 | |

* cited by examiner

IGNITION PLUG AND INTERNAL-COMBUSTION ENGINE

FIELD OF ART

The present inventions relate to an ignition plug having an antenna for emitting an electromagnetic (EM) wave, and an internal combustion engine having such an ignition plug.

BACKGROUND ART

An ignition plug with an antenna for emitting EM radiation is known. Patent document 1 describes such an ignition plug.

Patent document 1 (see FIG. 2) describes an ignition plug with an antenna located on the surface of the lower tip of an insulator. The antenna is made of an arc-like metallic foil with a predetermined width, and surrounds a center electrode, leaving space between it and the center electrode. A microwave signal is supplied to the antenna of the ignition plug from a high-pressure alternating current (AC) generator when a high voltage is applied from the ignition coil to the center electrode. In an engine employing the ignition plug, the air-fuel mixture is ignited when plasma generated by the microwave reacts with the spark discharge.

[Patent document 1] JP 2010-101174 A1

The ignition performance of a conventional ignition plug in an air-fuel mixture can be improved using a high-frequency EM wave emitted from an antenna by increasing the strength of the electric field in the electrical discharge area. This allows an internal combustion engine using such an ignition plug to reduce the pumping losses by achieving lean combustion of the air-fuel mixture and thereby improving the fuel efficiency.

The energy of the high-frequency EM wave is concentrated at the electrical discharge area and does not influence the propagation velocity of the flame. In an internal combustion engine, the amount of unburned fuel/air mixture may increase due to a decrease in the propagation velocity of the flame as the air-fuel mixture becomes lean. In an internal combustion engine using a conventional ignition plug, although the fuel efficiency can increase due to a decrease in the pumping losses, the overall fuel efficiency does not tend to increase, mainly because of the increased quantity of unburned fuel.

The present inventions are in view of this. The objective is to increase a propagation velocity of a flame by using a high frequency wave emitted from an antenna, in an ignition plug having the antenna for emitting high frequency wave to a combustion chamber of the internal combustion engine.

SUMMARY

The first invention relates to an ignition plug comprising the following. (a) An ignition plug body with a rod-shaped first conductive member, cylindrical insulation material surrounding the first conductive member, and a cylindrical second conductive member that accommodates the first conductive member and the insulation material. The body ignites the air-fuel mixture in the combustion chamber of the internal combustion engine when a potential difference is applied across the first and second conductive members, creating an electrical discharge on the front-tip side exposed to the combustion chamber. (b) An antenna attached to the ignition plug body that emits a high-frequency EM wave to the combustion chamber. The antenna is located on the front-tip side surface of the second conductive member.

In the first invention, the antenna is located on the front-tip side surface of the second conductive member of the ignition plug body. The antenna is provided on a surface of the second conductive member which is distant from the electrical discharging area.

In the second invention, the antenna of the first invention is located on the front tip surface of the second conductive member.

In the second invention, the antenna is located on the front tip surface of the second conductive member, not on the inner surface or outer surface.

In the third invention, the antenna of the second invention is located on the outer portion of the front tip surface of the second conductive member.

In the third invention, the antenna is positioned on the side distant from the electrical discharging area within the front tip surface of the second conductive member.

In the fourth invention, the antenna of either one of the first to third inventions is extended in the radial direction of the second conductive member.

In the fourth invention, the antenna is extended in the radial direction of the second conductive member. This allows the electric field to be enhanced in the area extended towards the radial direction of the second conductive member when high-frequency EM radiation is emitted from the antenna.

In the fifth invention, the antenna of the fourth invention is C-shaped or ring-shaped.

In the fifth invention, a C-shaped or ring-shaped antenna is located on the front-tip side surface of the second conductive member.

In the sixth invention, the antenna in either one of the first to fifth inventions is located on an insulation layer that is on the surface of the second lead material.

In the sixth invention, an insulating layer is formed on the surface of the second lead material, and the antenna is located on the insulation layer.

The seventh invention relates to an internal combustion engine comprising: (a) an internal combustion engine body having a combustion chamber and (b) an ignition plug with either one of the first to sixth inventions, attached to the body of the internal combustion engine. High-frequency EM radiation is emitted from the antenna to the combustion chamber simultaneously with the discharge of the ignition plug.

In the seventh invention, an ignition plug, having an antenna on the surface of the second conductive material, is attached to the body of the internal combustion engine. High-frequency EM radiation is emitted from the antenna to the combustion chamber simultaneously with the electrical discharge of the ignition plug.

The eighth invention relates to an internal combustion engine comprising: (a) an internal combustion engine body having a combustion chamber and (b) an ignition plug with either one of the first to sixth inventions, attached to the internal combustion engine body. High-frequency EM radiation is emitted from the antenna to the combustion chamber following ignition of an air-fuel mixture.

In the eighth invention, an ignition plug, having an antenna on the surface of the second conductive material, is attached to the internal combustion engine body. High-frequency EM radiation is emitted from the antenna to the combustion chamber immediately following ignition of an air-fuel mixture.

Advantages of the Present Inventions

In the present inventions, an antenna is located on the surface of the second conductive member within the ignition plug and distant from the electrical discharge area. This affords a reduction in the power of the high-frequency EM wave supplied to the electrical discharge area compared with a conventional ignition plug, and allows an increase in the high-frequency EM power supplied to the outside of the electrical discharge area. High-frequency EM energy is supplied to an area where the flame front passes immediately following ignition. Therefore, high-frequency EM radiation can affect the flame propagation, and may increase the propagation speed of the flame.

In the third invention, the antenna is located away from the electrical discharge area within the front tip surface of the second conductive member. This allows the high-frequency EM radiation to affect the flame propagation, and may increase the propagation velocity of the flame.

DESCRIPTION OF THE PREFERRED EMBODIMENTS

Figure 1:
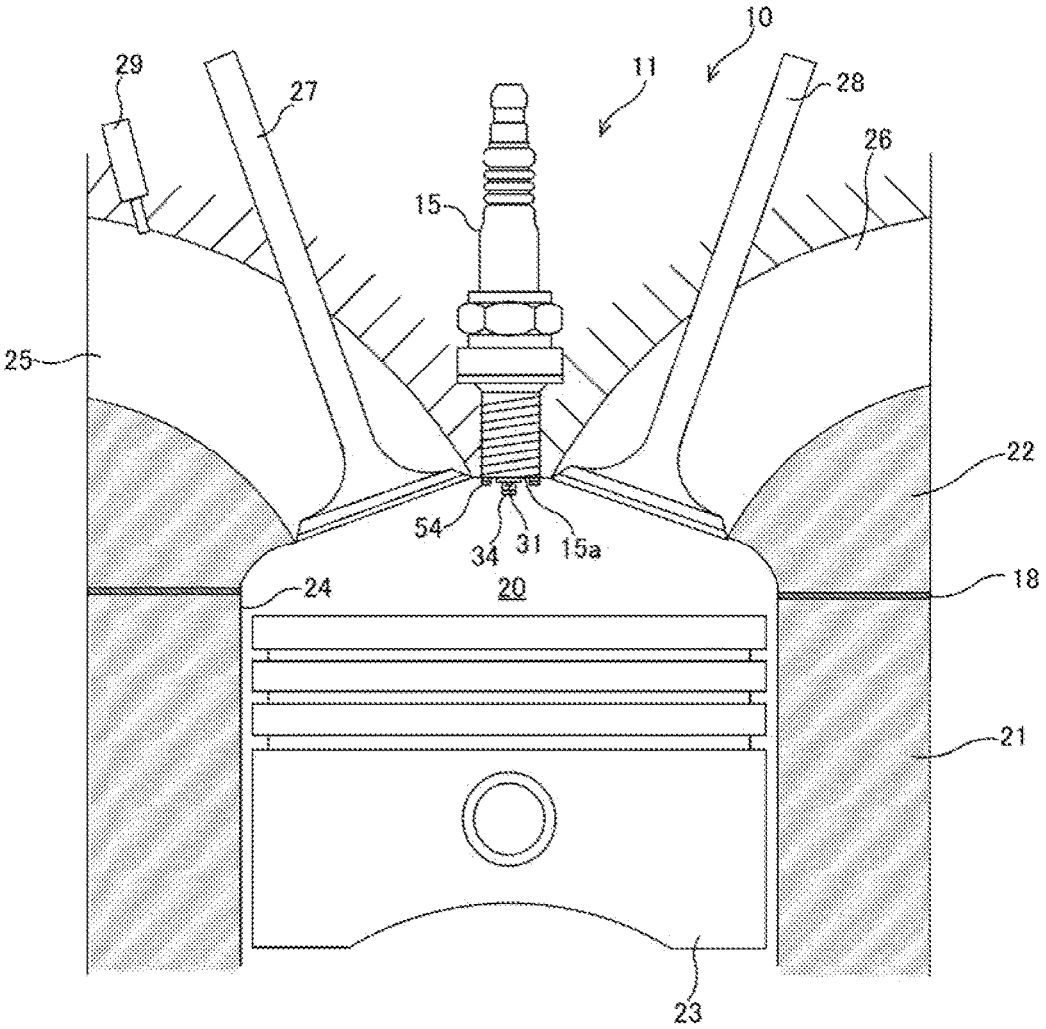
FIG. 1 illustrates an outline of the structure of an internal combustion engine according to one embodiment.

The embodiments of the present inventions are detailed with reference to the accompanying drawings. The embodiments below are the preferred embodiments of the inventions, but they are not intended to limit the scope of present inventions and applications or usage thereof.

Embodiment

The present embodiments relate to internal combustion engine 10, including ignition-plug (spark plug) 15 of the present invention. Internal combustion engine 10 is a reciprocating internal combustion engine where piston 23 reciprocates. Internal combustion engine 10 has internal combustion engine body 11, ignition device 40, and EM wave-emitting device 50.

Internal combustion engine body 11 has combustion chamber 20 formed therein. Ignition device 40 ignites an air-fuel mixture by generating plasma (volume plasma) that is stronger than the spark discharge (extra-fine non-volume plasma). EM wave-emitting device 50 has EM oscillator 52 that oscillates a microwave frequency (2.45 GHz) and antenna 54 emitting the microwave energy that is supplied from EM oscillator 52 to combustion chamber 20. EM wave-emitting device 50 emits microwave radiation from antenna 54 to supply the energy of the microwave to the flame, thereby increasing the propagation speed of the flame. Internal combustion engine 10 is controlled by electronically controlled device (ECU) 60.

Internal Combustion Engine Body

As illustrated in FIG. 1, internal combustion engine body 11 has cylinder block 21, cylinder head 22, and piston 23. Multiple cylinders 24, each having a rounded cross-section, are formed in cylinder block 21. Reciprocal pistons 23 are located in each of the cylinders 24. Pistons 23 are connected to a crankshaft through a connecting rod (not shown in the figure). The rotatable crankshaft is supported on cylinder block 21. The connecting rod converts reciprocation of pistons 23 to rotation of the crankshaft when pistons 23 reciprocate in each of cylinders 24 in the axial directions of cylinders 24.

Cylinder head 22 is located on cylinder block 21 sandwiching gasket 18 in between. Cylinder head 22 forms circular sectioned combustion chamber 20 together with cylinders 24 and pistons 23. The diameter of combustion chamber 20 is approximately half of the wavelength of the microwave radiation emitted from EM wave-emitting device 50.

A single ignition plug 15, which is a part of ignition device 40, is provided for each of cylinders 24 of cylinder head 22. In ignition plug 15, front tip part 15*a* that is exposed to combustion chamber 20 is placed at the center part of the ceiling surface of combustion chamber 20. Thus, this surface is exposed to combustion chamber 20 of cylinder head 22. Center electrode 31 and earth electrode 34 forms a discharge gap and these electrodes are installed on front tip part 15*a* of ignition plug 15. Ignition plug 15 is described in detail later.

Inlet port 25 and outlet port 26 are formed for each of cylinders 24 in cylinder head 22. Inlet port 25 has inlet valve 27 for opening and closing inlet port 25, and injector 29 that injects fuel. Outlet port 26 has outlet valve 28 for opening and closing outlet port 26.

Inlet port 25 is designed so that a strong tumble flow is formed in combustion chamber 20 in internal combustion engine 10. The tumble flow is formed during an air intake step and a compression step.

Ignition Device

Figure 2:
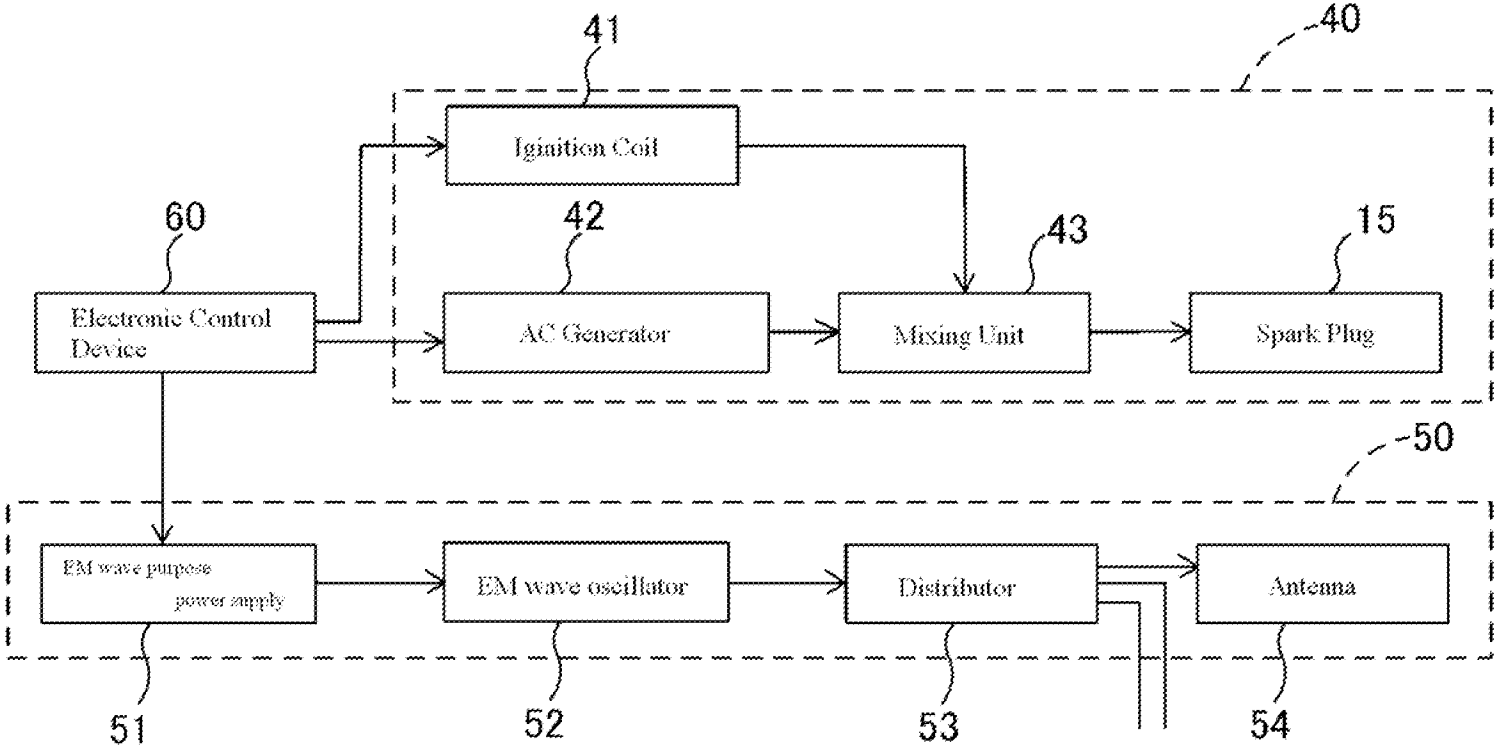
FIG. 2 shows a block diagram of an ignition device and an EM emission device according to one embodiment.

Ignition device 40 is provided for each combustion chamber 20. Ignition device 40 generates plasma that is stronger than the spark discharge by supplying high-frequency EM radiation to combustion chamber 20. As illustrated in FIG. 2, ignition device 40 has ignition coil 41 to output a high-voltage pulse, AC generator 42 to output an AC of frequency in the kHz to MHz range, e.g., 100 MHz, mixing unit 43 to mix the high-voltage pulse outputted from ignition coil 41 and the AC outputted from AC generator 42, and ignition plug 15 to receive the high-voltage pulse and the AC outputted from mixing unit 43. Ignition device 40 performs the ignition operation when an ignition signal is received from electronic controlled device 60.

Ignition coil 41 constitutes a high-voltage pulse-applying part that supplies a high-voltage pulse to center electrode 31 of ignition plug 15 for generating a spark discharge in a discharge gap. AC generator 42 constitutes a plasma expander that generates strong plasma by expanding the discharge plasma, which is generated accompanied by a spark discharge by supplying electrical energy to center electrode 31.

Ignition device 40 does not require ignition coil 41 or mixing unit 43. In this case, the output voltage and output time of the AC supplied by AC generator 42 are set so that plasma stronger than the spark discharge is formed.

The frequency of the alternating voltage outputted from AC generator 42 is set so that an electric field is induced in combustion chamber 20. The frequency of the microwave oscillated from EM wave oscillator 52 is set so that a radiated electric field is formed in combustion chamber 20. The frequency of the alternating voltage is lower than the microwave frequency outputted from EM wave oscillator 52.

Ignition coil 41 and AC generator 42 are connected to a DC power supply, e.g., a car battery (not shown in the figure). Ignition coil 41 raises the voltage applied from the DC power supply when an ignition signal is received from electronic control device 60, and then outputs the high-voltage AC to mixing unit 43. AC generator 42 raises the voltage applied from the DC power supply and converts it to AC when an ignition signal is received from electronic control device 60, and outputs the high-voltage AC to mixing unit 43. AC generator 42 outputs the high-voltage alternating current simultaneously with the outputs of the high-voltage pulse from ignition coil 41. Mixing unit 43 outputs a high-voltage pulse and the AC from the same output terminal; these are received by separate input terminals to center electrode 31 of ignition plug 15. In ignition plug 15, a spark discharge is generated in a discharge gap due to the high-voltage pulse when the high-voltage pulse and the high-voltage AC are applied to center electrode 31. Simultaneously, an electric field is formed in the discharge gap following the high-voltage AC. The plasma generated by the spark discharge expands to become strong plasma when the electrical energy of the AC is received. Strong plasma is generated in the spark electrical discharge area as a result of the reaction between the spark discharge and the electric field. The strong plasma is heat plasma.

In the above embodiment, an alternating voltage is applied to center electrode 31 of ignition plug 15. Instead, a continuous wave (CW) voltage can be applied to center electrode 31 for a predetermined period to generate the strong plasma. In each of the above cases, the amount of electrical energy supplied to ignition plug 15 during a single ignition is set so that the plasma survives in the presence of the strong tumble flow.

EM Wave-Emitting Device

As illustrated in FIG. 2, EM wave-emitting device 50 has EM wave power supply 51, EM wave oscillator 52, distributor 53, and multiple antennas 54. For instance, one power supply 51, one EM wave oscillator 52, and one distributor 53 are provided for single internal combustion engine 10. One antenna 54 is provided for each combustion chamber 20. FIG. 2 shows antenna 54 for one combustion chamber 20 only.

EM wave power supply 51 supplies a current pulse to EM wave oscillator 52 when (EM) wave driving signal is received from electronic control device 60. The EM wave driving signal is a pulse signal. Power supply 51 iteratively outputs a pulse current of a predetermined duty cycle between the rising and falling edges of the driving signal. The pulse current is outputted during the pulse width of the driving signal.

EM wave oscillator 52 may be a semiconductor oscillator, for example. EM wave oscillator 52 outputs a microwave pulse when a current pulse is received. EM wave oscillator 52 outputs microwave pulses during the pulse width of the driving signal. Other oscillators, such as a magnetron, may also be used as EM wave oscillator 52 instead of a semiconductor oscillator.

Distributor 53 switches the antenna for supplying a microwave outputted from EM wave oscillator 52 among multiple antennas 54. Distributor 53 supplies the microwave to multiple antennas 54 when a switching signal is received from electronic control device 60. Electronic control device 60 outputs the switching signals so that antenna 54 emits EM radiation immediately following ignition in each combustion chamber 20. Antenna 54 is located at the front tip surface of ignition plug 15. Antenna 54 is described in detail later.

Ignition Plug

Figure 3:
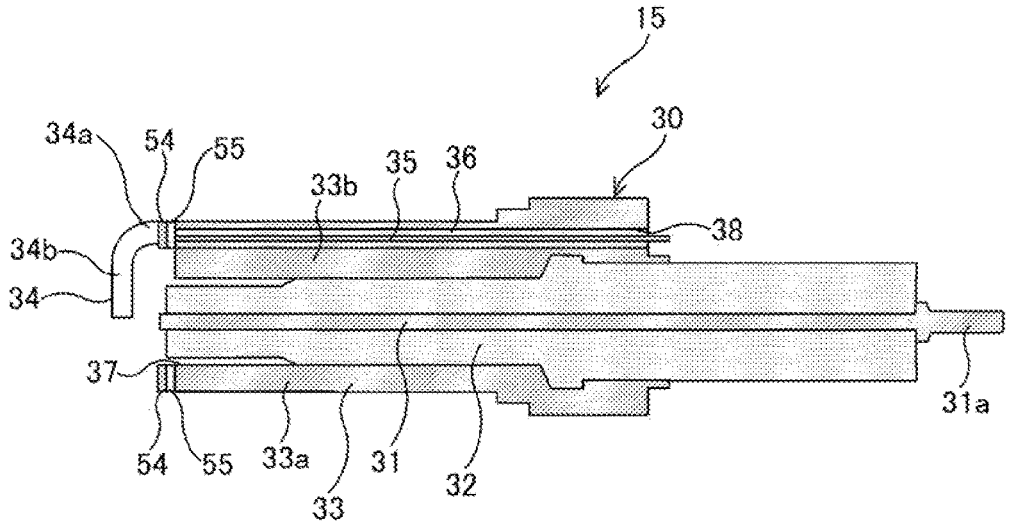
FIG. 3 shows a longitudinal sectional diagram of an ignition plug according to one embodiment.

As illustrated in FIG. 3, ignition plug 15 has ignition plug body 30 and antenna 54. Ignition plug body 30 has center electrode 31, insulator 32, housing 33, and earth electrode 34.

Center electrode 31 forms a rod-shaped first conductive member. Insulator 32 forms an insulating material that is substantially cylindrical, having center electrode 31 inside. Housing 33 forms a second conductive member that is substantially cylindrical and accommodates center electrode 31 and insulator 32. Housing 33 is electrically insulated from center electrode 31 using insulator 32.

Ignition plug body 30 is attached to a hole in cylinder head 22. Discharge occurs at the front-tip side of ignition plug body 30, which is exposed to combustion chamber 20, when a potential difference is applied between center electrode 31 and housing 33. Ignition plug body 30 then ignites the air-fuel mixture in combustion chamber 20.

Specifically, center electrode 31 is a columnar metal part that is fitted in insulator 32. The shaft axis of center electrode 31 coincides with the shaft axis of insulator 32. Connecting terminal 31*a* is formed at the rear tip of center electrode 31. An output terminal of mixing unit 43 is electrically connected to connection terminal 31*a*.

In this embodiment, ignition plug 15 is a non-resistor plug where center electrode 31 does not have a resistor. However, ignition plug 15 does not have to be a non-resistor plug; a resistor may be located in center electrode 31.

Insulator 32 is formed cylindrically such that the external diameter changes in the longitudinal direction. Insulator 32 may be made of ceramic, for example. In insulator 32, the external diameter is smallest on the side exposed to combustion chamber 20.

Housing 33 is metal and is substantially cylindrical. First penetration hole 37, with a circular cross section, is formed inside housing 33. First penetration hole 37 is formed eccentrically from the shaft axis of the outer surface of housing 33. In other words, the shaft axis of first penetration hole 37 is formed shifted from the shaft axis of the outer surface of housing 33. Insulator 32 fits into the first penetration hole 37. The wall surface of first penetration hole 37 makes contacts with the outer surface of insulator 32, except for the front-tip side of ignition plug body 30. In the front-tip side of ignition plug body 30, a space is formed between the inner surface of housing 33 and the outer surface of insulator 32.

The external diameter of housing 33 increases as the distance from the front tip of ignition plug body 30 increases. On the outer surface of housing 33, a thread groove (not shown in the figure) is formed at the front-tip side of housing 33 where the outside diameter is a minimum. Ignition plug body 30 is attached to cylinder head 22 by screwing the thread groove on the outer surface of housing 33 to the thread groove of the hole in cylinder head 22. Housing 33 is grounded by making contact with cylinder head 22. As illustrated in FIG. 1, the front tip part 15*a* of ignition plug body 30 is exposed to combustion chamber 20 when ignition plug body 30 is attached to cylinder head 22.

Earth electrode 34 is connected to the front tip surface of housing 33. Earth electrode 34 protrudes in the axial direction of ignition plug 15 from the front tip surface of ignition plug 15, and is curved in the middle toward the inner side of ignition plug 15 to face the front-tip side of center electrode 31. In earth electrode 34, the rear side of the curved portion constitutes rear edge portion 34*a*, and the front side of the curved portion constitutes front tip portion 34*b*. A discharge gap is formed between front tip portion 34*b* of earth electrode 34 and the front tip surface of center electrode 31.

Figure 4:
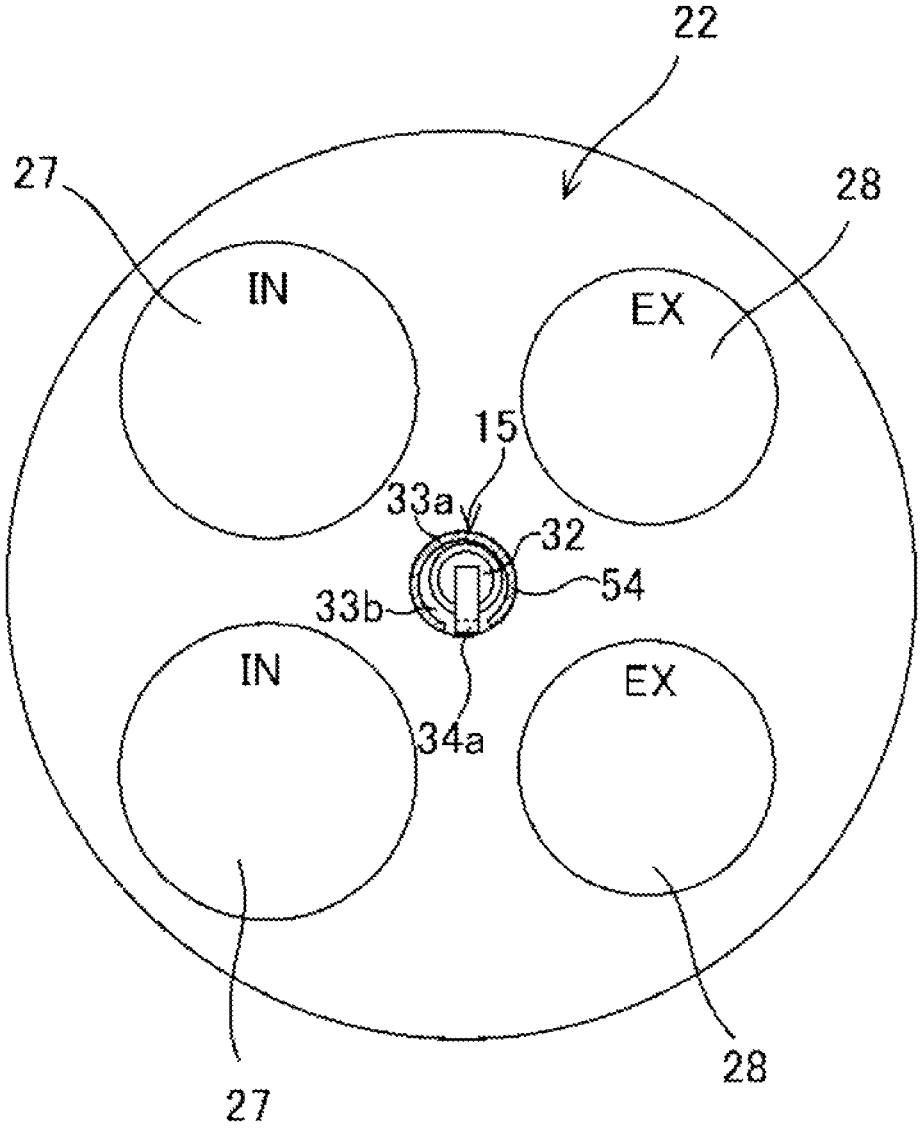
FIG. 4 illustrates a front view of the ceiling side of a combustion chamber of an internal combustion engine according to one embodiment.

In this embodiment, antenna 54 is provided on the surface of front tip part 15*a*, exposed to combustion chamber 20, of housings 33 intervening insulation layer 55 (insulator). Specifically, antenna 54 is provided on the front tip side of housing 33. Antenna 54 is electrically insulated from housing 33 using insulation layer 55. Antenna 54 is C-shaped thin-plate. As shown in FIG. 4, antenna 54 is located so that the both ends are sandwiched between housing 33 and base end section 34. Antenna 54 extends in the radial direction of housing 33. The width of antenna 54 is constant in the radial direction of housing 33. The outer surface of antenna 54 almost coincides with the outer surface of housing 33 when it is viewed from the front side. Antenna 54 is disposed on the front tip side of housing 33 and at the position near the outer surface of housing 33.

In housing 33, eccentric first penetration hole 37 is located as discussed above. This allows housing 33 to have thin-wall part 33*a*, which is on the eccentric side of first penetration hole 37, and thick-wall part 33*b*, which is thicker than thin-wall part 33*a*. Rear-tip part 34*a* of earth electrode 34 is on thick-wall part 33*b*.

Thick-wall part 33*b* has second penetration hole 38 formed thereon, penetrating in the axial direction of housing 33, to allow a coaxial line to pass and supply the microwave signal to antenna 54. The coaxial line is formed through second penetration hole 38 by rod-shaped center conductor 35, cylindrical insulator 36, and a wall face of the second penetration hole 38 which has a cylindrical surface. Center conductor 35 is insulated electrically from housing 33 using insulator 36. The front tip portion of center conductor 35 is capacitively coupled with one tip of antenna 54 through insulation layer 55. The rear tip of center conductor 35 is connected to distributor 53 through a coaxial cable (not shown in the figure). The front tip of center conductor 35 may be connected directly to antenna 54 by penetrating into insulation layer 55.

Ignition and Emission

The ignition operation of the air-fuel mixture from ignition device 40 and the emission operation of EM wave-emitting device 50 immediately following the ignition operation are discussed below.

Ignition device 40 ignites the air-fuel mixture just before piston 23 reaches top dead centre (TDC) of internal combustion engine 10. Ignition is executed in response to the output of the ignition signal from electronic control device 60. In ignition device 40, high-voltage pulses are emitted from ignition coil 41 in response to the ignition signal, and a high-voltage AC is output from AC voltage generator 42. In the discharge gap of ignition plug 15, to where the high-voltage pulse and the high-voltage AC are supplied, plasma is generated and the air-fuel mixture is ignited as discussed above. The plasma allows ignition of a lean air-fuel mixture.

ECD 60 outputs an EM wave driving signal following ignition of an air-fuel mixture, i.e., at a predetermined time after the ignition signal. The EM wave-driving signal is output before the flame front that extends from the inside of antenna 54 passes antenna 54.

In EM wave-emitting device 50, EM wave power supply 51 outputs current pulses with a pulse width period of the received EM wave-driving signal. EM wave oscillator 52 outputs a microwave pulse to distributor 53 when a current pulse is received. The microwave signal inputted to distributor 53 is emitted from antenna 54 to post-ignition-state combustion chamber 20. The microwave radiation is emitted before and after the flame front passes antenna 54.

A large electric field is formed in combustion chamber 20 near antenna 54. In this embodiment, the electric field is formed outside (when viewed from the front side) the electrical discharge area (discharge gap) because antenna 54 is located outside the electrical discharge area. The plasma is generated in the region of the electric field, and activated species such as radical OH. are generated. An oxidation reaction of the flame passing the electric field area is advanced by the activated species. Further, electrons in the flame receive energy from the EM wave in the region of the electric field. As a result, the propagation speed of the flame front increases.

Advantages of Embodiment

In this embodiment, antenna 54 is located on the surface of housing 33 and away from the electrical discharge area in ignition plug 15. Therefore, microwave energy can be supplied to the area where the flame front passes and the propagation speed of the flame can increase.

In this embodiment, the propagation speed of the flame can increase efficiently because antenna 54 is located away from the electrical discharge area on the front-tip side of housing 33.

Modified Embodiment

In a modified embodiment, microwave radiation is emitted from antenna 54 to combustion chamber 20 simultaneously with a discharge from ignition plug 15. ECD 60 outputs an ignition signal and an EM wave-driving signal at the ignition timing before piston 23 reaches compression TDC.

In the modified embodiment, microwave radiation is emitted from antenna 54 in combustion chamber 20 while the plasma is generated by ignition device 40. The plasma generated by ignition device 40 expands when the microwave radiation is absorbed. The temperature of the plasma (which is enlarged by the microwave radiation) decreases as a whole compared with the pre-expansion state. Therefore, the survival time of the activated species, such as radical OH., increases compared with the pre-expansion state. Therefore, chemical reactions of the air-fuel mixture (i.e., oxidation) are promoted, and the propagation speed of the flame front increases due to the activated species.

In the modified embodiment, the concentration of electrical energy is avoided in the electrical discharge area because antenna 54 is located away from the electrical discharge area. Microwave radiation is emitted from outside the plasma generated by ignition device 40, and the plasma expands efficiently. Therefore, the propagation speed of the flame can be increased efficiently using the microwave radiation.

Other Embodiments

The above embodiment can be configured as follows.

In the above embodiment, internal combustion engine 10 can be a direct-injection engine, or a rotary engine.

In the above embodiment, ignition device 40 can also ignite an air-fuel mixture using a spark discharge. In this case, ignition device 40 does not have AC voltage generator 42 or mixing unit 43.

A plasma jet ignition plug 15 can be used in the above embodiment. A small space that is a part of combustion chamber 20 is formed at front tip part 15*a* of ignition plug 15. A continuous voltage or repetitive voltage pulse is applied to ignition plug 15, and the plasma generated in the small space injects plasma into combustion chamber 20 located outside the small space.

In the above embodiment, the plasma may be also generated by supplying a large current stored in a capacitor to ignition plug 15 immediately following application of the high-voltage pulse using ignition coil 41.

In the above embodiment, antenna 54 may be formed in a ring-like fashion, rather than a C-shape.

Antenna 54 may be covered with an insulator or dielectric material. In this case, antenna 54 is coated with insulation layer 55 and a covering insulator.

In the above embodiment, the propagation speed of the flame can be increased by generating microwave plasma from the back side of the flame surface by emitting microwave radiation in the area where the flame front has passed.

In the above embodiment, the coaxial line can be split into multiple lines inside housing 33 so that each line is connected or coupled to antenna 54.

INDUSTRIAL APPLICABILITY

As discussed above, the present inventions allow an ignition plug with an antenna to emit EM radiation, and are useful for an internal combustion engine having the above ignition plug.

DESCRIPTION OF REFERENCE NUMERALS

10: internal combustion engine
15: ignition plug
20: combustion chamber
30: ignition plug body
31: center electrode (first conductive member)
32: insulators (insulation material)
33: housing (second conductive member)
34: earth electrode
54: antenna

The invention claimed is:

1. An ignition plug comprising:

an ignition plug body having a rod-shaped first conductive member, a cylindrical insulating material surrounding the first conductive member, and a cylindrical second conductive member having an eccentric penetration hole that houses therein the first conductive member and the insulating material, the cylindrical second conductive member having an earth electrode exposed to a combustion chamber so as to form a discharge gap between the earth electrode and the first conducting member, wherein an air-fuel mixture within the combustion chamber of an internal combustion engine is ignited when a potential difference is applied between the first conductive member and the cylindrical second conductive member, and electricity is discharged at the discharge gap; and an antenna attached to the ignition plug body that emits high-frequency EM radiation, which is externally provided, to the combustion chamber, wherein the antenna is located on a front-tip side surface of the cylindrical second conductive member and has two ends each reaching a vicinity of a base end of the earth electrode such that the antenna in its entire length extends along an outer circumferential edge of the cylindrical second conductive member, and a central axis of the eccentric penetration hole is shifted from a central axis of the cylindrical second conductive member.

2. The ignition plug as claimed in claim 1, wherein the antenna is C-shaped or ring-shaped.

3. The ignition plug as claimed in claim 1, wherein the antenna is located on an insulation layer that is on the surface of the cylindrical second conductive material.

4. An internal combustion engine comprising:

an internal combustion engine body having a combustion chamber;

an ignition plug as claimed in claim 1, and attached to the internal combustion engine body;

wherein a high-frequency EM wave is emitted from the antenna to the combustion chamber simultaneously with a discharge of the ignition plug.

5. An internal combustion engine comprising:

an internal combustion engine body having a combustion chamber;

an ignition plug as claimed in claim 1, and attached to the internal combustion engine body;

wherein a high-frequency EM wave is emitted from the antenna to the combustion chamber following ignition of an air-fuel mixture.

6. The ignition plug as claimed in claim 1, wherein the antenna has an elongated body which is located radially outside an inner circumferential edge of the cylindrical second conductive member and contacts the front-tip side surface of the cylindrical second conductive member.

7. The ignition plug as claimed in claim 1, wherein the antenna is disposed at the position where at least a portion of the antenna abuts the outer circumferential edge of the cylindrical second conductive member.

8. An ignition plug comprising:

an ignition plug body having a rod-shaped first conductive member, a cylindrical insulating material surrounding the first conductive member, and a cylindrical second conductive member having an eccentric penetration hole that houses therein the first conductive member and the insulating material, wherein an air-fuel mixture within a combustion chamber of an internal combustion engine is ignited when a potential difference is applied between the first conductive member and the cylindrical second conductive member, and electricity is discharged on a front-tip side that is exposed to the combustion chamber; and an antenna attached to the ignition plug body that emits high-frequency EM radiation, which is externally provided, to the combustion chamber, wherein the antenna is located on a front-tip side surface of the cylindrical second conductive member and C-shaped or ring-shaped such that the antenna in its entire length extends along an outer circumferential edge of the cylindrical second conductive member, and a central axis of the eccentric penetration hole is shifted from a central axis of the cylindrical second conductive member.

* * * * *